United States Patent [19]

Jacobson

[11] 4,253,237

[45] Mar. 3, 1981

[54] RAZOR HANDLE

[75] Inventor: Chester F. Jacobson, Southboro, Mass.

[73] Assignee: The Gillette Company, Boston, Mass.

[21] Appl. No.: 49,920

[22] Filed: Jun. 19, 1979

[51] Int. Cl.[3] ..... B26B 21/52

[52] U.S. Cl. ..... 30/89

[58] Field of Search ..... 30/47, 50, 51, 57, 87, 30/88, 89

[56] References Cited

U.S. PATENT DOCUMENTS

| | | | |
|---|---|---|---|
| 996,879 | 7/1911 | Odell | 30/87X |
| 1,441,016 | 1/1923 | Matthews | 30/89 X |
| 1,675,128 | 6/1928 | Ostrovsky | 30/89 X |
| 2,386,536 | 10/1945 | Bensel | 30/47 |
| 3,593,416 | 7/1971 | Edson | 30/57 X |
| 4,026,016 | 5/1977 | Nissen | 30/47 |
| 4,057,896 | 11/1977 | Trotta | 30/89 X |
| 4,094,063 | 6/1978 | Trotta | 30/47 |

FOREIGN PATENT DOCUMENTS

| | | | |
|---|---|---|---|
| 95521 | 4/1924 | Austria | 30/89 |
| 1460732 | 1/1977 | United Kingdom . | |

*Primary Examiner*—Gary L. Smith

*Attorney, Agent, or Firm*—Richard A. Wise; Scott R. Foster

[57] ABSTRACT

A razor handle for a razor blade assembly adapted to be pivotally mounted on the handle, the razor handle having first and second arm portions with journal means disposed thereon for pivotal connection to journal bearing means on the blade assembly, each arm portion having cam means thereon engageable with complementary cam means on the blade assembly, the cam means cooperating to urge the pivotally mounted blade assembly toward a neutral position.

4 Claims, 6 Drawing Figures

RAZOR HANDLE

BACKGROUND OF THE INVENTION

1. Field of the Invention

This invention relates to razors for wet shaving, and is directed more particularly to a razor for use with a blade assembly which is movable during a shaving operation.

2. Discussion of the Prior Art

Razors having facility for mounting blade asemblies thereon to permit movement of the blade assembly during a shaving operation are known in the art. U.S. Pat. No. 4.083,104, in the name of Warren I. Nissen discloses such a razor. The razor shown in FIGS. 1–5 and 7 has opposed and aligned journal means disposed on arm portions. The journal means are adapted to interfit with journal bearings on the blade assembly, shown in FIG. 6, to provide a pivotal mounting. To release the blade assembly, the arms are pivotally moved outwardly from each other to release the shaving assembly. The pivotal movement of the arms is rapid and causes an outward movement of the blade assembly. In addition, the razor is provided with a spring biased cam follower extending from the razor to engage a cam surface on the underside of the blade assembly to urge the pivotally mounted blade assembly to a neutral position. Upon movement of the arms of the razor outwardly, to release the blade assembly, the spring biased cam follower exercises a degree of outward thrust upon the cartridge, contributing to its propulsion outwardly from the razon upon release. Generally, such outward propulsion of the blade assembly is deemed undesirable. It is preferable that, upon release, the blade assembly be simply released, rather than thrust away from the razor.

SUMMARY OF THE INVENTION

It is therefore, an object of the invention to provide a razor handle for a movably mounted blade assembly, the handle being adapted to release the blade assembly without ejecting the blade assembly from the razor handle.

With the above and other objects in view, as will hereinafter appear, a feature of the present invention is the provision of a razor handle for a razor blade assembly adapted to be pivotally mounted on the handle, the razor handle having first and second arm portions with journal means thereon for pivotal connection to journal bearing means on the blade assembly, each arm portion having cam means thereon engageable with complementary cam means on the blade assembly, the cam means cooperating to urge the pivotally mounted blade assembly toward a neutral position.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent. In the drawings.

DESCRIPTION OF THE PREFERRED EMBODIMENT

Figure 1:
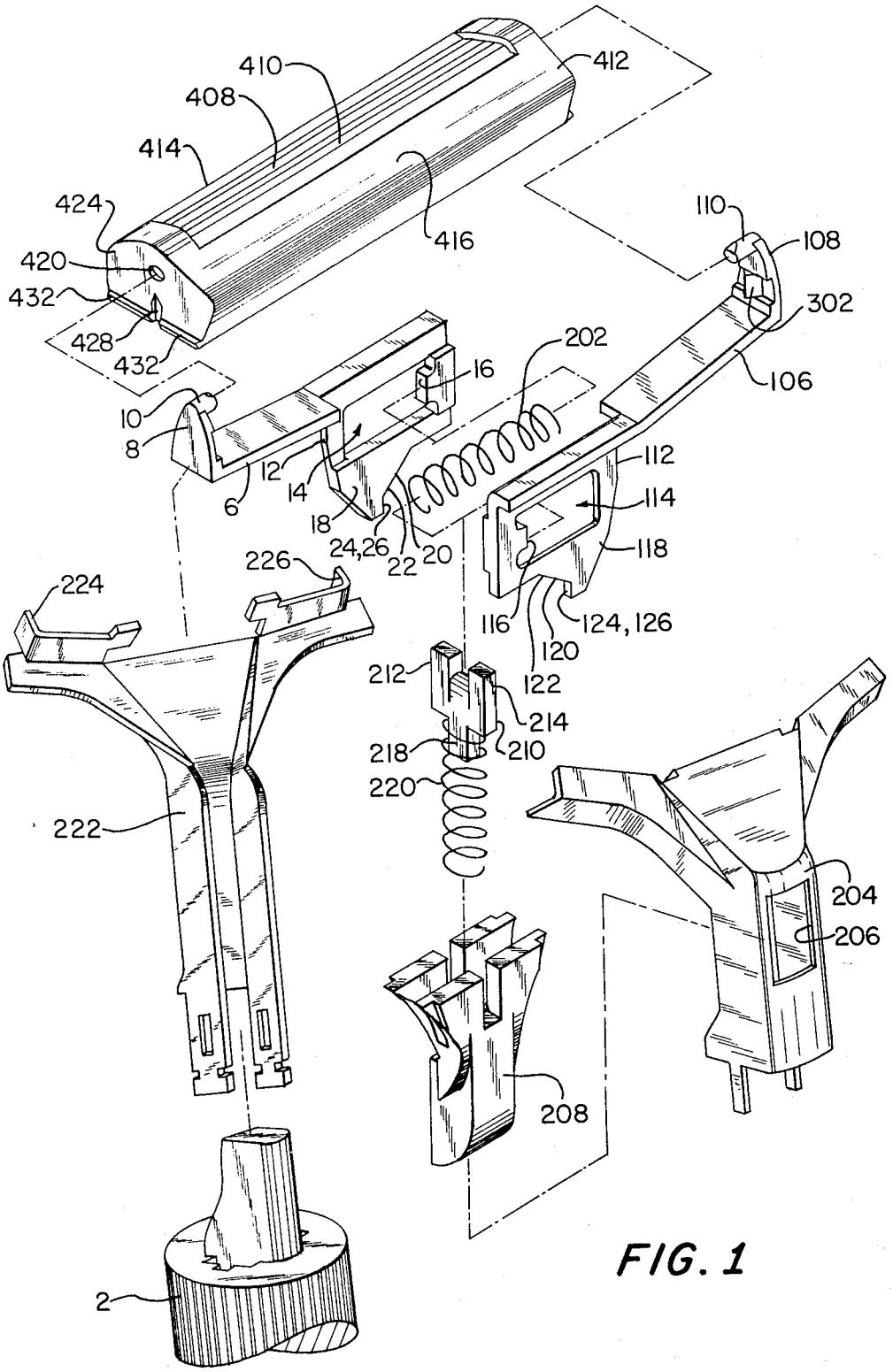
FIG. 1 is a perspective exploded view of one form of razor handle illustrative of an embodiment of the invention.

Referring to the drawings, it will be seen that the razor includes a grip portion 2 and a head portion 4. The head portion 4 includes a first arm 6 having an upstanding end portion 8. A first pivot mounting means, preferably a journal 10 is fixed to the first arm end portion 8. Affixed to the first arm 6 is a first frame member 12 having an opening 14 therein. A first protrusion 16 extends inwardly of the opening 14 from a side of the first frame member 12. Extending downwardly from a bottom portion of the first frame member 12, as viewed in the drawings, is a first extension 18 having an inclined edge 20 forming a first cam surface 22, and an edge surface 24 defining a first channel wall 26, which will be further described below.

The head portion 4 further includes a second arm 106 having an upstanding end portion 108. A second pivot mounting means, preferably a journal 110 is fixed to the second arm end portion 108. Affixed to the second arm 106 is a second frame member 112 having an opening 114 therein, the opening 114 being generally in alignment with the first opening 14. A second protrusion 116 extends inwardly of the opening 114 from a side of the second frame member 112, the second protrusion 116 being generally opposed to the first protrusion 16. Extending downwardly from a bottom portion of the second frame member 112, as viewed in the drawings, is a second extension 118 having an inclined edge 120 forming a second cam surface 122, and an edge surface 124 defining a second channel wall 126, the first and second channel walls 26, 126 defining a channel 200 therebetween, the channel 200 leading to an intersection of the opposed first and second cam surfaces 22, 122.

A coil spring 202 is disposed in the openings 14, 114, fitted over the protrusions 16, 116. The spring 202 operates to urge the frame members 12, 112 to stay in substantial alignment with each other and biases the frame members 12, 112 toward the position shown in FIG. 2.

The head portion 4 includes a first housing member 204 having an opening 206 therein. Extending through the opening 206 is a push button 208 in which is mounted a bifurcated actuator 210 having upstanding lugs 212, 214 defining a recess 216 therebetween. The actuator 210 includes a stem portion 218 about which there is disposed a coil spring 220. The actuator 210 engages the opposed first and second cam surfaces 22, 122 by way of the channel 200, the lug 212 being on one side of the extensions 18, 118 and the lug 214 being on the other. The coil spring 220 maintains the actuator 210 in engagement with the cam surfaces 22, 122.

The head portion 4 further includes a second housing member 222, which along with the first housing member 204, enclose the above described mechanism. The second housing member 222 includes a pair of upstanding detents 224, 226 which are disposed proximate to the arm end portions 8, 108, respectively.

In operation, the journals 10, 110 must be moved outwardly from each other to accept a shaving unit therebetween. The shaving unit (described hereinbelow) is provided with complementary pivot mounting means, preferably journal bearings which accept the journals 10, 110 for pivotally mounting the shaving unit on the razor. To separate the journals 10, 110, an operator depresses the push button 208, urging the actuator forcefully against the cam surfaces 22, 122, causing the frame members 12, 112 to slide in opposite directions along the axis of the coil spring 202, compressing the spring 202. The arm end portions are then positioned to bring the journals 10, 110 into register with the aforementioned journal bearings. Upon release of the button 208, the coil spring 202 causes the frame members 12, 112 to snap back into alingment and the opposed journals 10, 110 to move along their axes toward one another to engage the shaving unit.

To release the shaving unit, the operation is repeated, the journals 10, 110 being thereby caused to move outwardly along their aligned axes to separate from the shaving unit and thereby release the shaving unit from the razor.

The upstanding detents 224, 226 are operative to prevent accidental endwise movement of the shaving unit which might cause separation of the journals and inadvertant release of the shaving unit.

Figure 5:
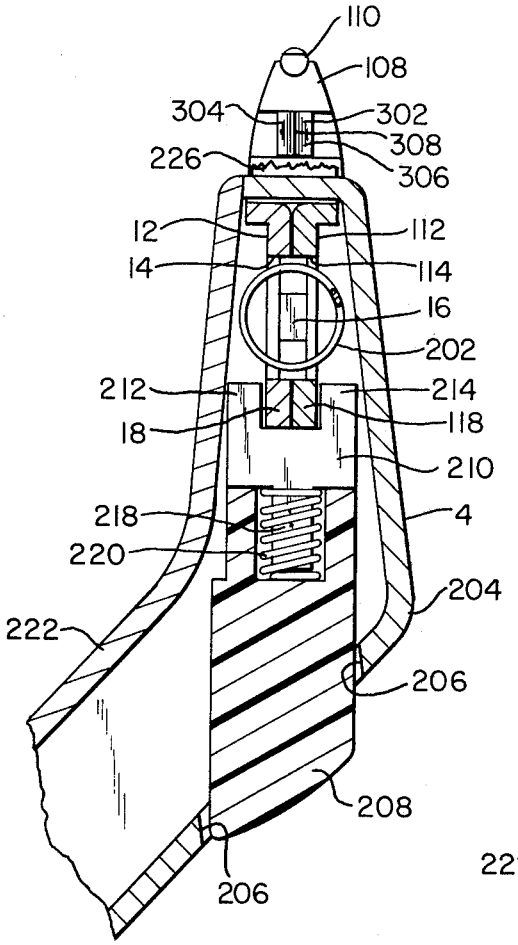
FIG. 5 is a sectional view of the handle taken along line V—V of FIG. 3.

Referring again to the drawings, it will be seen that the first and second arm portions 6, 106 are each provided with cam means 300, 302 thereon, the cam means being engageable with complementary cam means on the blade assembly (further described below). The cam means 300, 302 cooperate with the blade assembly cam means to urge the pivotally mounted blade assembly toward a neutral position. In the illustrative example, the cam means 300, 302 each comprise an inwardly extending protrusion formed integrally with the upstanding end portion 8, 108 of either arm 6, 106. Each cam is generally V-shaped and includes a pair of cam surfaces 304, 306 (FIG. 5) intersecting at an apex 308.

Figure 4:
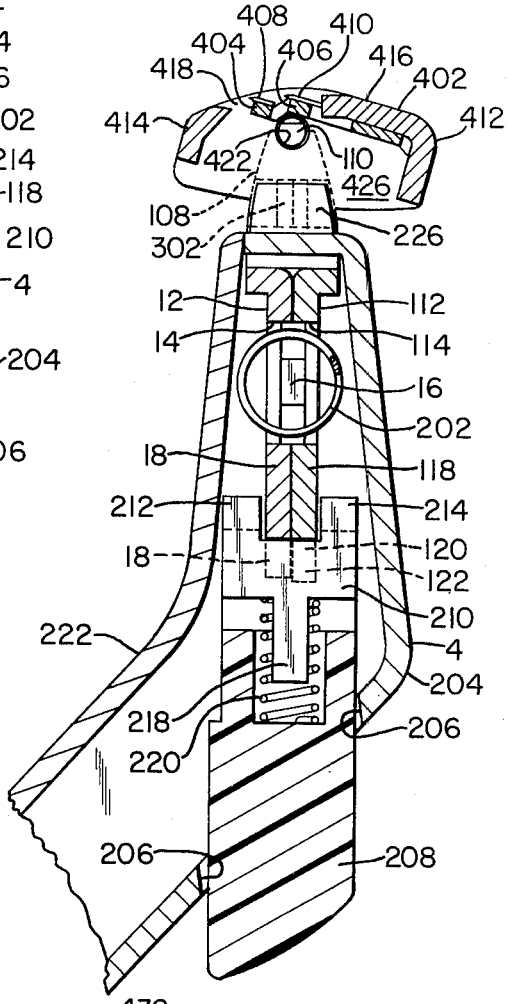
FIG. 4 is a sectional view of the handle and blade assembly taken along line IV—IV of FIG. 2.

Referring particularly to FIG. 4, it will be seen that the illustrative blade assembly includes a frame portion 402 including blade support portions 404, 406 to which are attached blade means 408, 410. The frame portion 402 is retained in a housing 412 having a guard portion 414 and a cap portion 416, the blade means 408, 410 being disposed in an opening 418 therebetween.

Figure 2:
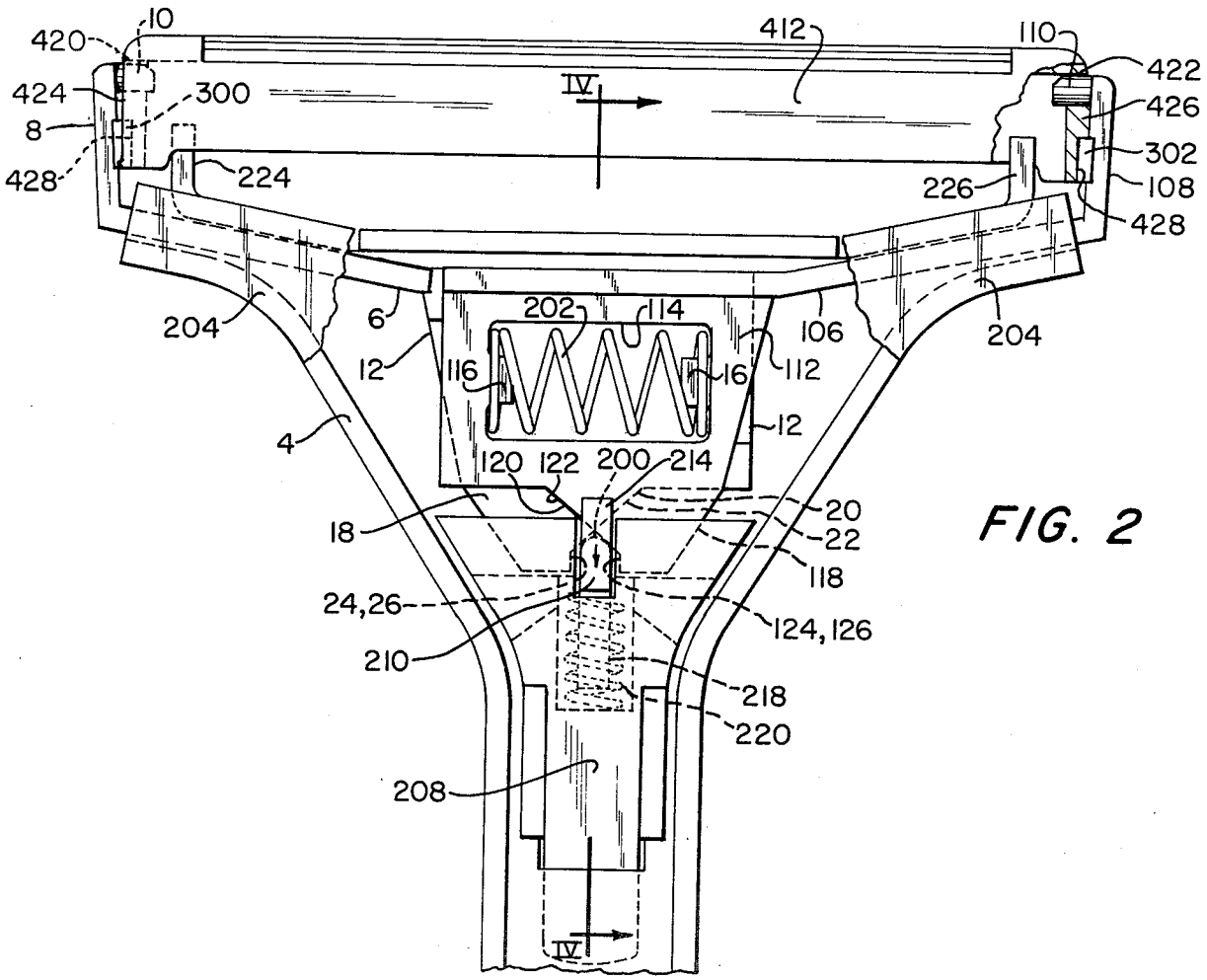
FIG. 2 is a rear elevational view, in part broken away, the handle being shown with the cam means in the blade assembly engaging position.
Figure 3:
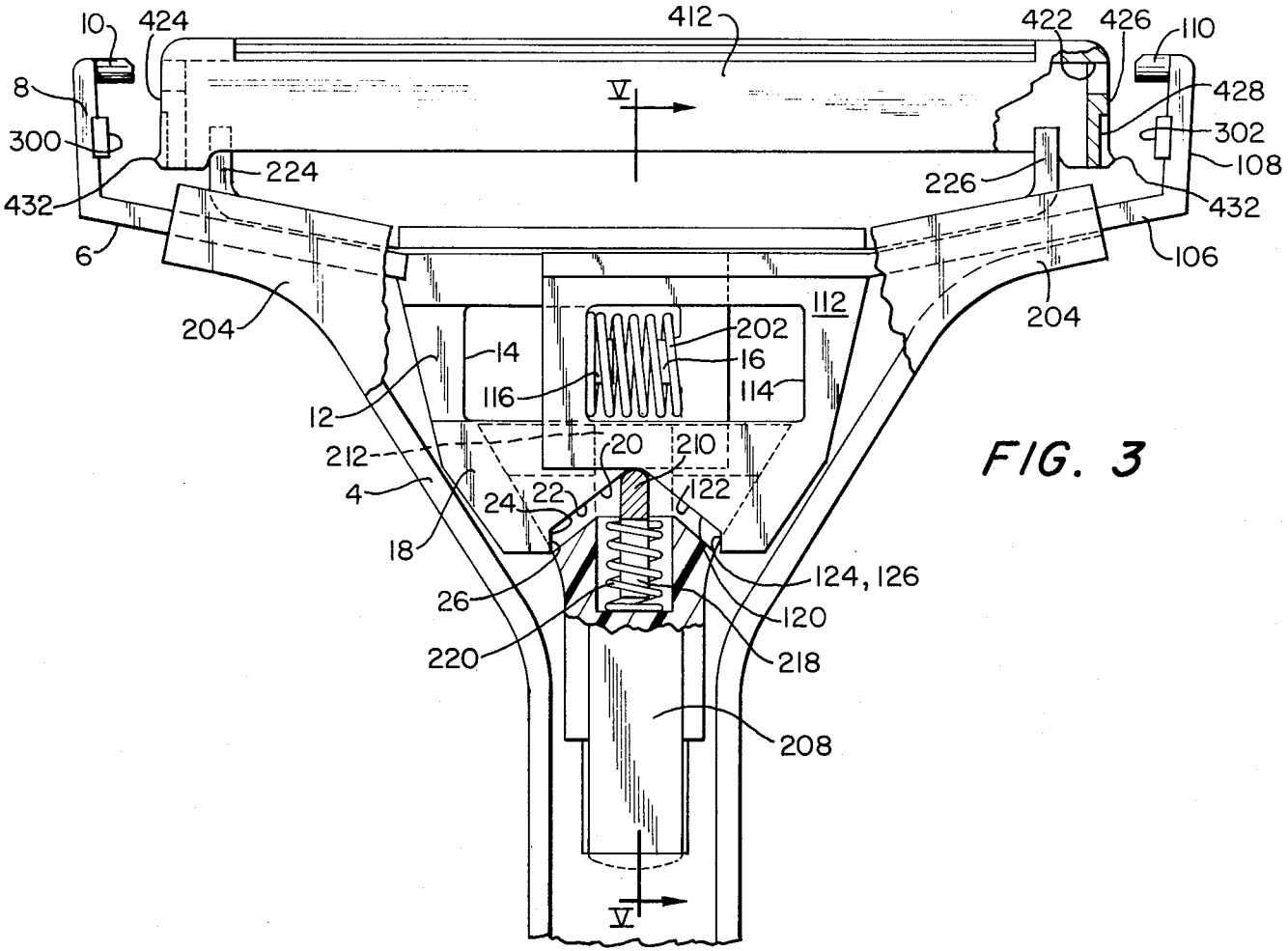
FIG. 3 is similar to FIG. 2, but showing the arms of the handle in the blade assembly release position and the cam means disengaged from the blade assembly.
Figure 6:
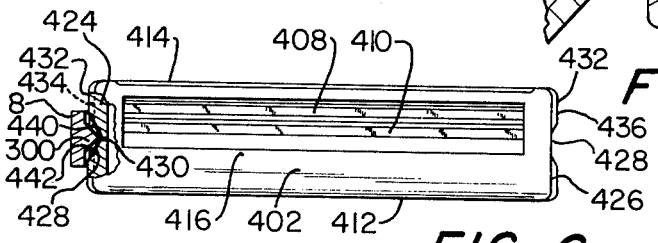
FIG. 6 is a top plan view partly broken away of the blade assembly adapted for use with the illustrative handle.

The blade assembly includes complementary pivot mounting means preferably a pair of journal bearings 420, 422 (FIGS. 2 and 3). In the illustrative embodiment, the journal bearings 420, 422 are disposed in end walls 424, 426, respectively, of the housing 412. On each of the end walls 424, 426, proximate the pertinent journal bearings, there is disposed a recess 428. Referring particularly to FIGS. 1 and 6, it will be seen that the recess 428 broadens outwardly from its inwardmost point 430, as viewed in FIG. 6. Each end wall 424, 426 of the housing is provided with a ridge 432. The recess 428 extends through the ridge 432. The edges of the recess 428 converge as the recess extends downwardly from the ridge to the base 434 of the housing end wall 424, 426. Referring to FIG. 6, it will be seen that the recess 428 is deepest in the area of the ridge 432 and tapers toward the outer surface of the end wall 424, 426. The taper of the recess toward the crest 436 of the ridge 432 defines cam surfaces 440, 442 adapted to receive the above-described cam members 300, 302 disposed on the first and second arm portions of the razor to which the blade assembly is connected. The journal bearings 420, 422 are adapted to accept the journal members 10, 110 disposed on the aforementioned first and second razor arm portions, thereby a facilitate pivotal movement of the blade assembly on the razor during a shaving opertion.

In connection of the blade assembly to a razor, the journal bearings 420, 422 receive the journals 10, 110 on the razor and the recesses 428 receive the cam members 300, 302 on the razor. Each cam member engages the deepest portion of its respective recess. During a shaving operation, pivotal movement of the blade assembly about an axis extending through the bearings 420, 422 causes movement of the recess, such as to bring one or the other of the cam surfaces 440, 442 to bear against the complemental surfaces of the cam members. The cam members seek the deepest portion of the recesses and thereby urge the return of the blade unit to its "neutral" position.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A razor handle for a razor blade assembly adapted to be pivotally mounted on the handle, said handle comprising first and second arm portions, first and second pivot mounting means respectively disposed on said first and second arm portions and adapted to engage complementary pivot mounting means on said blade assembly to effect said pivotal mounting, and first and second cam means disposed respectively on said first and second arm portions and engageable with complementary cam means on said blade assembly, said first and second cam means each being removed from but proximate one of said arm portion pivot mounting means, said first and second cam means extending inwardly from said arm portions in opposed fashion, each of said first and second cam means being generally V-shaped, said cam means cooperating to urge said pivotally mounted blade assembly toward a neutral position.

2. The invention in accordance with claim 1 in which each of said first and second cam means comprises a cam member having first and second cam surfaces extending obliquely from its respective arm portion, said first and second surfaces intersecting at an apex.

3. The invention in accordance with claim 1 in which said cam means are formed integrally with said arm portions.

4. The invention in accordance with claim 1 in which said razor handle includes a grip portion and said arm portions include base portions extending transversely to said grip portion, each of said arm portions having an end portion upstanding from an end of said base portion, one of said pivot mounting means being mounted on each of said end portions and extending inwardly therefrom toward the other of said pivot mounting means, and one of said first and second cam means being mounted on each of said end portions and extending inwardly therefrom toward the other of said first and second cam means, said first and second cam means being disposed between said proximate pivot mounting means and said arm base portions.

* * * * *